US005294083A

United States Patent [19]

Roth

[11] Patent Number: 5,294,083

[45] Date of Patent: Mar. 15, 1994

[54] COMBINED DRINK HOLDER & BEACH BLANKET HOLDER

[76] Inventor: Peter Roth, 1450 Lakeshore Dr., Massapequa Park, N.Y. 11762

[21] Appl. No.: 898,489

[22] Filed: Jun. 15, 1992

[51] Int. Cl.[5] ..... A47G 23/02

[52] U.S. Cl. ..... 248/146; 248/156; 248/508

[58] Field of Search ..... 248/146, 156, 507, 508, 248/530, 532, 533, 87, 153, 545, 311.2

[56] References Cited

U.S. PATENT DOCUMENTS

| | | | |
|---|---|---|---|
| 1,369,315 | 2/1921 | Ankers | 248/153 |
| 2,506,321 | 5/1950 | Vosburgh | 248/153 |
| 2,520,818 | 8/1950 | Terry | 248/153 |
| 2,574,441 | 11/1951 | Stewart | 248/87 |
| 2,768,805 | 10/1956 | Gribble | 248/508 |
| 2,899,153 | 8/1959 | Parker | 248/508 |
| 4,334,661 | 6/1982 | Pitt | 248/156 |
| 4,650,146 | 3/1987 | Duke | 248/533 |
| 4,825,575 | 5/1989 | Rethke | 248/533 |

*Primary Examiner*—Scott Smith
*Attorney, Agent, or Firm*—Galgano & Belkin

[57] ABSTRACT

A combined drink holder and beach blanket holder. A stake is adapted to be inserted into the sand. A hollow drink holder is mounted on top of the stake. A hook member is mounted on the stake, the hook member being adapted to hold down an edge of a blanket lying on the sand.

4 Claims, 1 Drawing Sheet

COMBINED DRINK HOLDER & BEACH BLANKET HOLDER

This invention relates to drink holders for use on a beach and, more particularly, the invention provides a combined drink holder and beach blanket holder.

BACKGROUND

When sitting on a beach it is difficult to provide a secure holder for drink containers, and it is also difficult to anchor a beach blanket. The present invention performs both functions.

PRIOR ART

The following prior art is shown:

| | |
|---|---|
| 2,520,818 | 4,749,162 |
| 2,623,633 | 4,927,118 |
| 4,334,661 | |

None of the references show the Applicant's specific invention.

THE INVENTION

A combined drink holder and beach blanket holder. A stake is adapted to be inserted into the sand. A hollow drink holder is mounted on top of the stake. A hook member is mounted on the stake, the hook member being adapted to hold down an edge of a blanket lying on the sand.

OBJECTS OF THE INVENTION

A principal object of the invention is to provide a new and improved drink holder for beach use.

Another object of the invention is to provide a new and improved drink holder and beach blanket holder.

Another object of the invention is to provide a new and improved combined drink holder and beach blanket holder comprising; a stake adapted to be inserted into the sand, a hollow drink holder mounted on top of the stake, a hook member mounted on the stake, the hook member being adapted to hold down an edge of a blanket lying on the sane.

These, and other objects of the invention will be apparent from the following specification and drawings, of which:

PREFERRED EMBODIMENT

Figure 1:
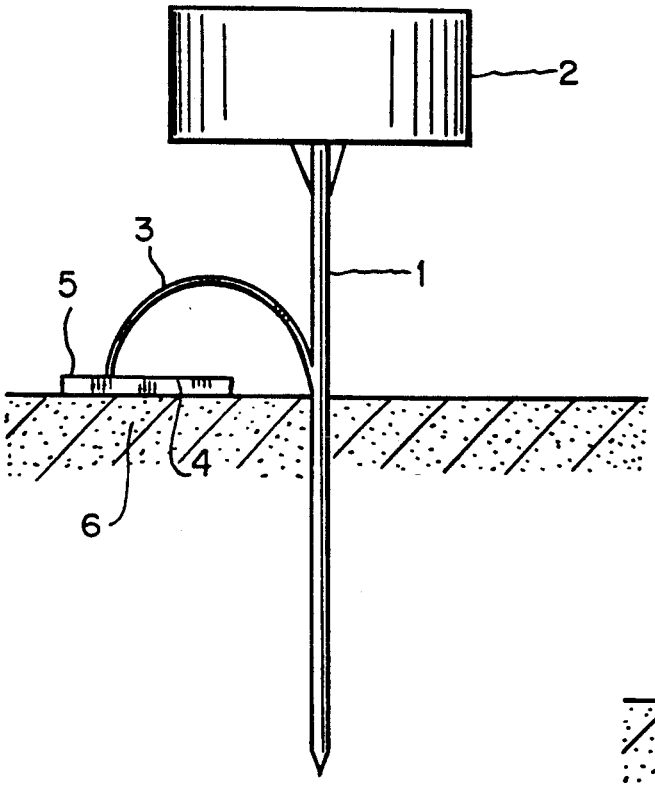
FIG. 1 is a side view of an embodiment of the invention.

Referring to the figures, the invention comprises a stake 1, upon which is mounted a hollow drink holder 2. A hook member 3 is mounted on the stake member 1 and is adapted to hold down the edge 4 of a beach blanket lying on the top of the sand 6.

In use, after the beach blanket is located on the sand, the stake 1 can be inserted into sand so that the stake hook 3 holds down the edge of the beach blanket 5.

Figure 2:
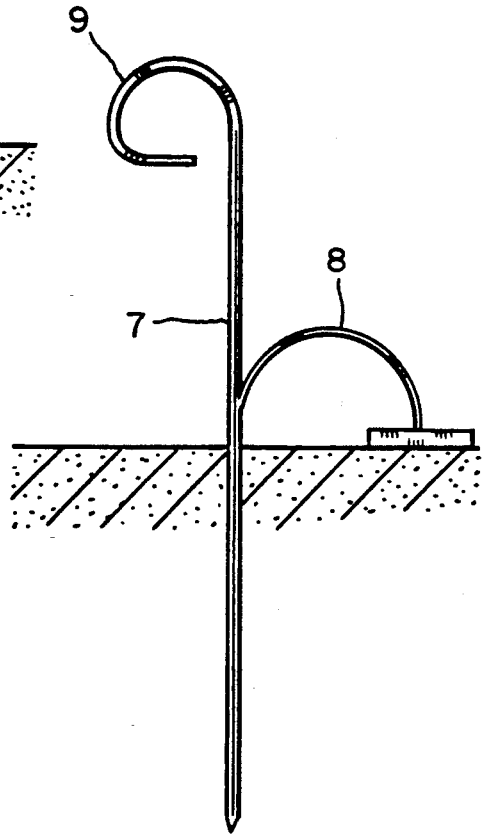
FIG. 2 is a side view of another embodiment of the invention.
Figure 3:
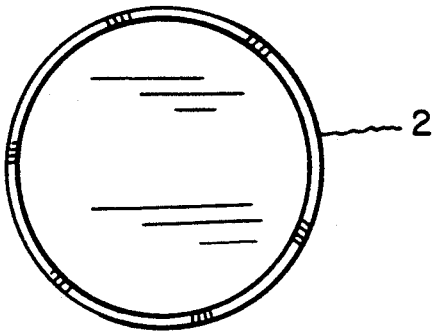
FIG. 3 is a top view of FIG. 1.

FIG. 2 shows a stake member 7, with a hook 8 and a handle 9. These stake members may be mounted around the blanket as desired to hold the blanket in place.

I claim:

1. A combined drink and beach blanket holder comprising:
   - a stake having an upper end and a lower end, the latter of which is insertable into sand;
   - a drink holder mounted on said upper end of said stake; and
   - a hold-down member, mounted on the stake in between said upper and lower ends thereof, disposed generally normally to said stake and being spaced from said drink holder such that when said stake is inserted into sand, said hold-down member will engage and hold down a beach blanket disposed below and against the sand and thereby position said drink holder above and spaced from the sand.

2. The claim according to claim 1, wherein said stake, drink holder and hold-down member are made of plastic.

3. The claim according to claim 1, wherein said hold-down member comprises an arcuate arm, one end of which is attached to said stake, and the other end of which serves to hold down the edge of a beach blanket.

4. The claim according to claim 1, wherein said drink holder comprises a cylindrical, cup-shaped body.

* * * * *